US006637362B1

(12) United States Patent
Avidiya

(10) Patent No.: US 6,637,362 B1
(45) Date of Patent: Oct. 28, 2003

(54) SECTIONAL BOAT

(76) Inventor: James E. Avidiya, 83412 Williamson La., Dexter, OR (US) 97431

( * ) Notice: Subject to any disclaimer, the term of this patent is extended or adjusted under 35 U.S.C. 154(b) by 0 days.

(21) Appl. No.: 10/162,512

(22) Filed: Jun. 3, 2002

(51) Int. Cl.[7] ..... B63B 7/04
(52) U.S. Cl. ..... 114/352
(58) Field of Search ..... 114/352, 353, 114/77 R, 354

(56) References Cited

U.S. PATENT DOCUMENTS 957,820 A 5/1910 Vaniman
1,148,961 A 8/1915 Ellison
3,266,067 A 8/1966 Windle
3,822,427 A * 7/1974 Ewart, Jr. ..... 114/352
4,478,167 A 10/1984 Hart
4,892,055 A * 1/1990 Schad ..... 114/357

* cited by examiner

*Primary Examiner*—Sherman Basinger
(74) *Attorney, Agent, or Firm*—Robert E. Howard

(57) ABSTRACT

A sectional boat having first and second buoyant hulls joinable together at their transoms. The transoms, or transom plates attached to the outer surface of each of the transoms, have a corrugated outer surface comprised of substantially horizontal ridges and furrows. The ridges and furrows of the transoms or transom plates are adapted to interlock when the transoms are joined together. The transoms or transom plates of the first hull may include a plurality if locking projections adapted to be received in locking openings contained in the transom or transom plates of the second hull. The hulls further include wheel assemblies extending upwardly from their stern sections and at least one handle extending from their bow sections to permit easy movement of the hulls on land.

11 Claims, 3 Drawing Sheets

SECTIONAL BOAT

BACKGROUND OF THE INVENTION

The present invention relates to a boat formed of two joinable hull sections, each hull section being independently floatable.

It is known to form a boat from two or more independent hull sections having square sterns which are fastened together at their transoms, each section being independently buoyant. See, for example, U.S. Pat. 4,478,167. Such hull sections have abutting transoms and the transoms are typically fastened together by fastening members passing through the transoms above and below the waterline.

When such boats are placed into the water, the diverse forces generated by the water acting upon the boat sections try to twist and vertically move the adjacent transoms relative to each other. Such twisting and vertical movement forces can cause the fastener members to jam, making it difficult to separate the sections, or cause the fastener members to fail.

SUMMARY OF THE PRESENT INVENTION

The present invention is a sectional boat having first and second buoyant hulls joinable together at their transoms. The transoms, or transom plates attached to the outer surface of each of the transoms, have a corrugated outer surface comprised of substantially horizontal ridges and furrows. The ridges and furrows of the transoms or transom plates are adapted to interlock when the transoms are joined together.

The hulls further include wheel assemblies extending upwardly from their stern sections and at least one handle extending from their bow sections to permit easy movement on land.

DESCRIPTION OF PREFERRED EMBODIMENTS

Figure 1:
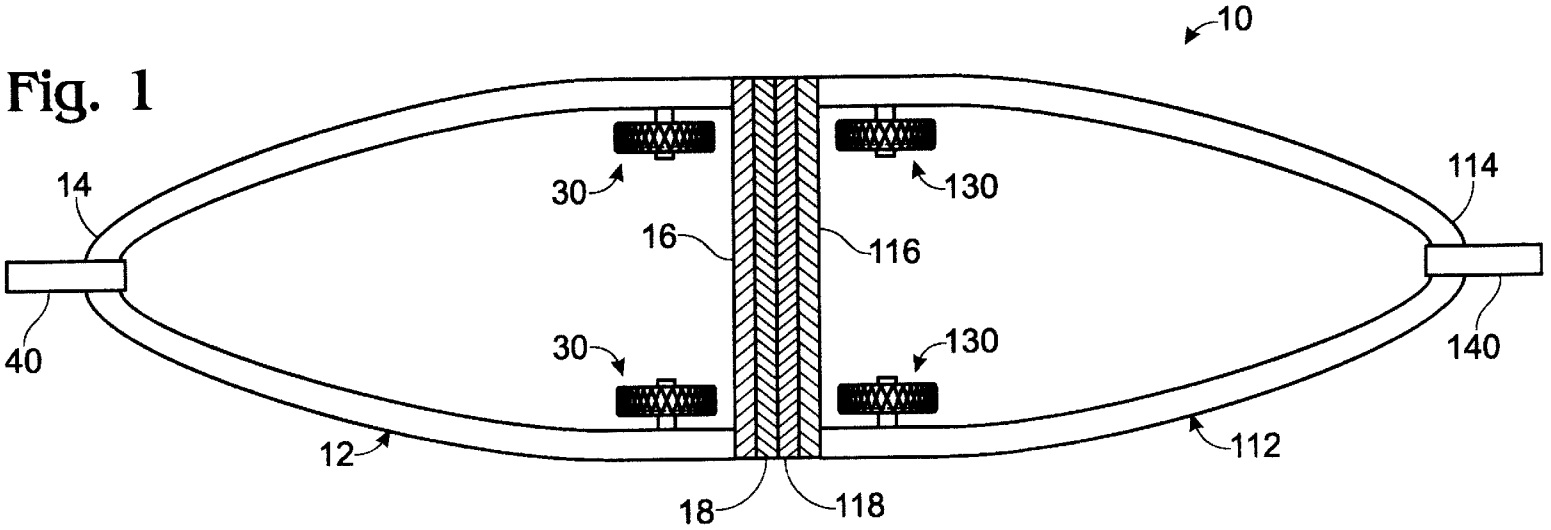
FIG. 1 is a top plan view of the boat of the present invention.
Figure 2:
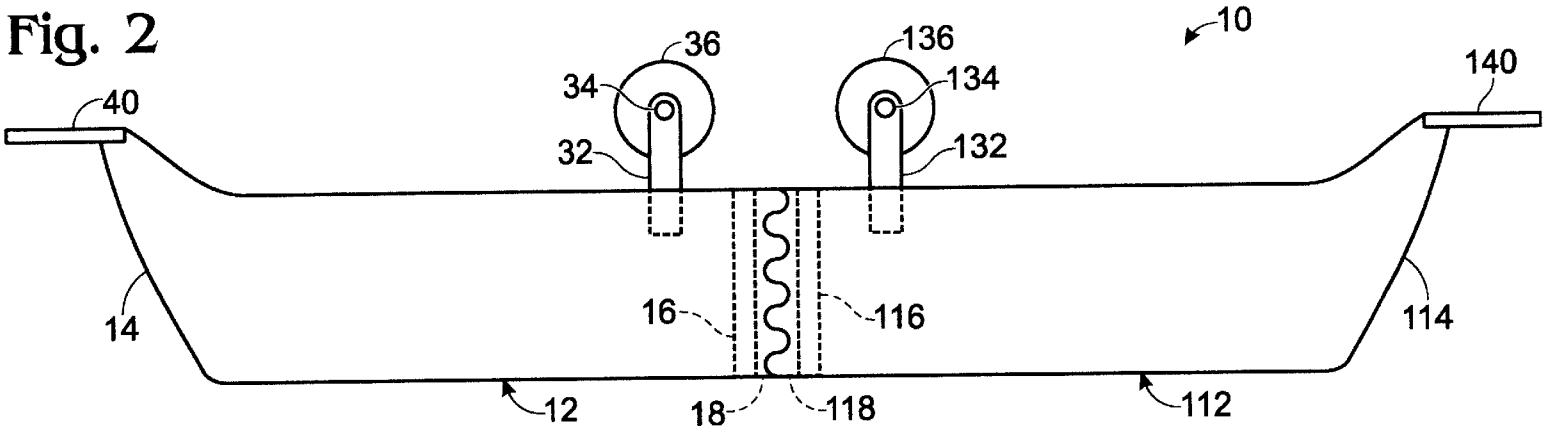
FIG. 2 is a side elevation view, partially in section, of the boat of the present invention.
Figure 3:
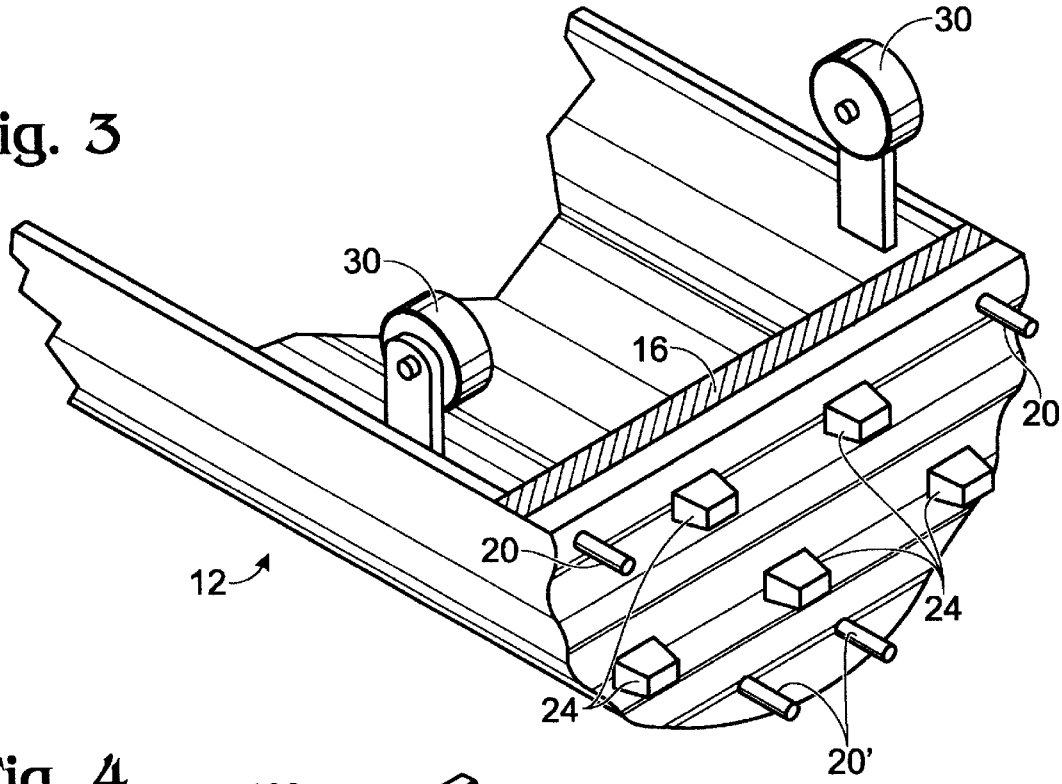
FIG. 3 is a perspective view of the stern of a first of the boat sections of the present invention.
Figure 4:
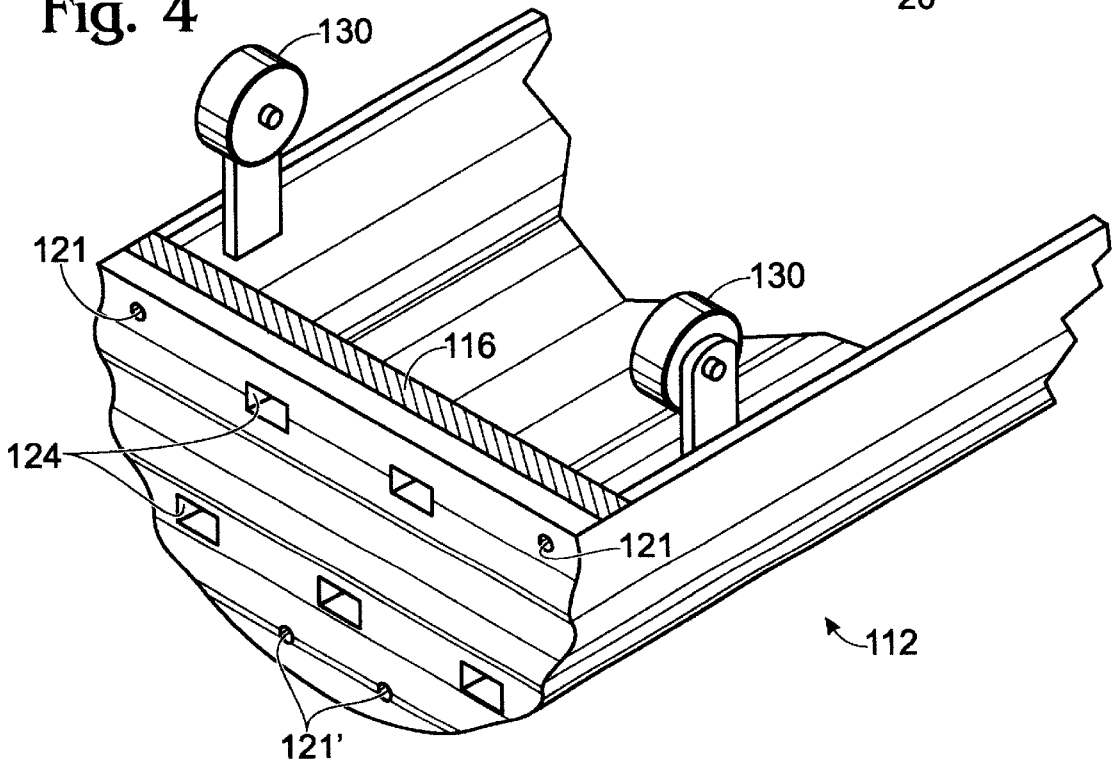
FIG. 4 is a perspective view of the stern of the second of the boat sections of the present invention.

The sectional boat 10 of the present invention is formed of a first buoyant hull section 12 and a second buoyant hull section 112. Hull sections 12 and 112 are substantially identical, and parts of second hull section 112 identical to parts of first hull section 12 will have the same reference number as the reference number of the hull section 12 parts but increased by 100.

Hull section 12 has a bow 14 and a transom 16. Hull section 112 has a bow 114 and a transom 116.

A corrugated transom plate 18 is attached to transom 16 of hull section 12 and a corrugated transom plate 118 is attached to transom 116 of hull section 112. The transom plates may be attached to the transom by any suitable attachment means, such as adhesive, threaded fasteners, etc.

Transom plates 18 and 118 have a size and shape substantially identical to the size and shape of transom 16 and 116, respectively, to which they are attached.

Figure 5:
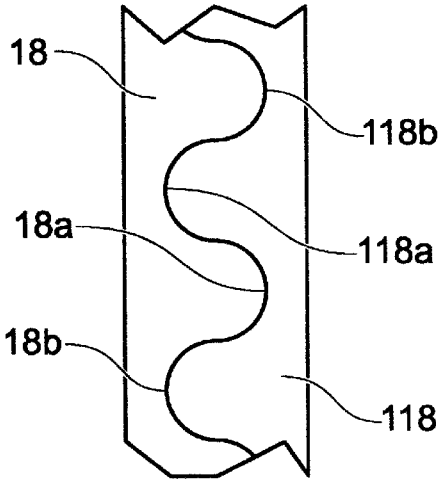
FIG. 5 is an enlarged, fragmentary, side elevation view of the corrugated transom plates closely adjacent each other.
Figure 7:
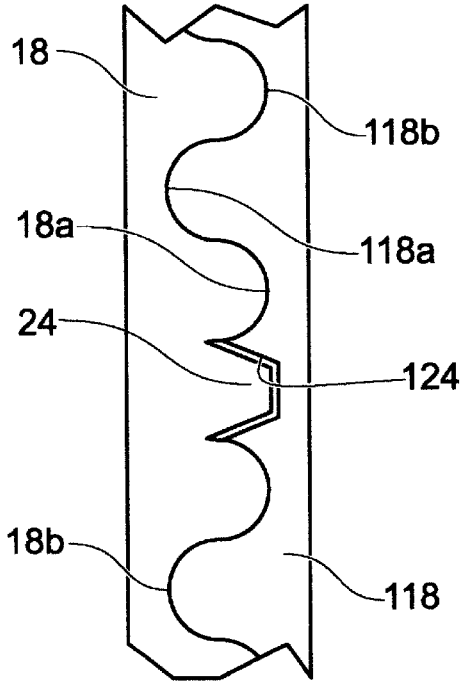
FIG. 7 is an enlarged, fragmentary, side elevation view through one of the locking projections.
Figure 6:
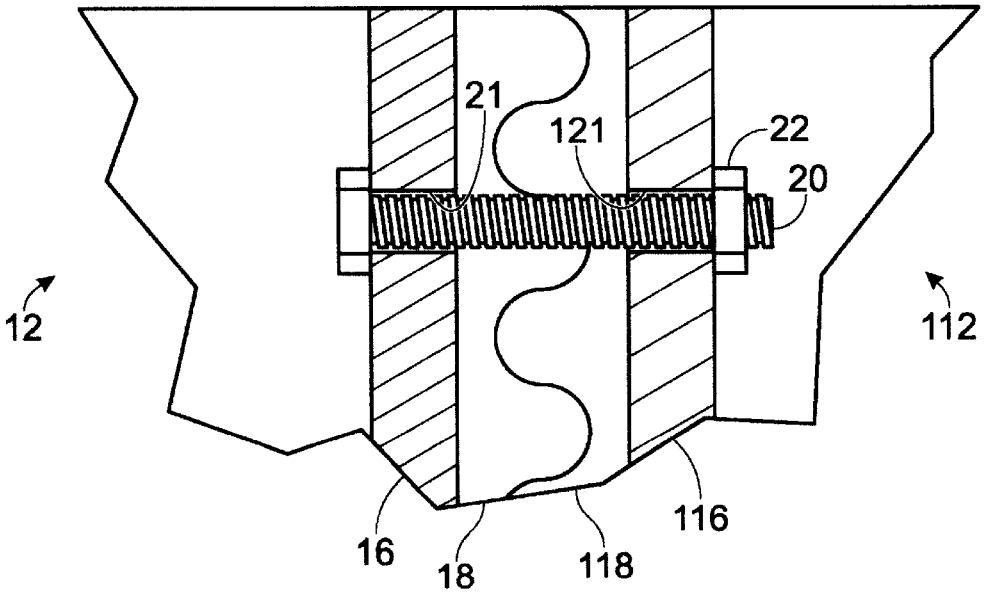
FIG. 6 is an enlarged, fragmentary, side elevation view of one of the fasteners used to connect the boat sections of the present invention together.

The outer surface of transom plates 18 and 118 have corrugations comprised of substantially horizontal ridges 18*a* and 118*a*, respectively, and furrows 18*b* and 118*b*, respectively. The corrugations formed by ridges 18*a* and 118*a* and furrows 18*b* and 118*b* have cross-sections that are identical, but with ridges 18*a* and 118*a* and furrows 18*b* and 118*b* being out of phase with each other in order that the ridges of one transom plate interlocks with the furrows of the other transom plate, as best seen in FIGS. 5 and 6.

Although the ridges and furrows of the outer surfaces of transom plates 18 and 118 are illustrated as having a cross-sectional shape that is semi-circular, other cross-sectional shapes, such as a saw tooth pattern, may be employed.

It is preferred that transom plates 18 and 118 be formed of a compressible material, such as an elastomer or rubber, in order to dampen abrasion between the transom plates. However, other abrasion and rust resistant materials, such as ultrahigh molecular weight polyethylene, may be used.

Although it is preferred that transom plates 18 and 118 be separate elements attached to transoms 16 and 116, transom plates 18 and 118 and transoms 16 and 116, respectively, may be formed as an integral, one piece element.

The boat sections 12 and 112 may be fastened together at their sterns and above the waterline by any suitable fastening means, such as nuts 20 and bolts 22 passing through openings 21 in transom 16 and through openings 121 in transom 116 and through openings in transom plates 18 and 118 which snugly press against bolts 22, only one of which fastening members 20, 22 is shown in FIG. 6. Two or more such fastening members 20 may be located above the waterline and two or more fastening members 20' located below the waterline.

The interlocking corrugations of the outer surfaces of transom plates 18 and 118 minimize or prevent twisting and vertical movement of hull sections 12 and 112 relative to each other when the sections are fastened together and boat 10 placed in the water.

A plurality of locking projections 24 may also extend outwardly from transom plate 18 which are adapted to snugly fit into locking openings 124 located in transom plate 118. Locking projections 24 provide additional stabilization against yawing.

Since each of hull sections 12 and 112 are buoyant, they may be independently used as boats when not attached together.

To facilitate transport of hull section 12 on land, port and starboard wheel assemblies 30 are attached to, and extend upwardly from, the stern section of hull 12. Wheel assembly 30 includes an axle mounting member 32, a stub axle 34 and a wheel 36. Wheel assemblies 30 can be adapted to fold downwardly against the inside of hull section 12 during the time the hull section is in the water.

A handle 40 is attached to the bow section 14 to allow hull section 12 to be easily pushed when wheels 36 are in contact with the ground. While only one handle has been illustrated, two handles similar to those used with wheelbarrows may extend from the bow section 14.

Similarly, hull section 112 includes port and starboard wheel assemblies 130 are attached to the stern section of hull 112. Wheel assembly 130 includes an axle mounting member 132, a stub axle 134 and a wheel 136. Wheel assemblies 130 can be adapted to fold downwardly against the inside of hull section 112 during the time the hull section is in the water.

A handle 140 is attached to the bow section 114 to allow hull section 112 to be easily pushed when wheels 136 are in contact with the ground. While only one handle has been illustrated, two handles similar to those used with wheelbarrows may extend from the bow section 114.

It will be obvious to those having skill in the art that many changes may be made to the details of the above-described embodiments of this invention without departing from the underlying principles thereof. The scope of the present invention should, therefore, be determined only by the following claims.

The invention claimed is:

1. In a sectional boat having first and second buoyant hulls, each said hull having a bow section and a stern section including a transom, said first and second hulls having joinable first and second transoms, the improvement comprising said first and second transoms having a corrugated outer surface comprised of ridges and furrows, the ridges and furrows of said first transom adapted to interlock with the ridges and furrows of said second transom, said transom of said first buoyant hull having a plurality of locking projections extending therefrom and said transom of said second buoyant hull having a plurality of locking openings located therein but not extending therethrough and adapted to snugly receive said locking projections, locking means openings passing through said first and second transoms, and locking means passing through said locking means openings.

2. The sectional boat of claim 1 wherein said transoms are formed of an abrasion and rust resistant material.

3. The sectional boat of claim 2 wherein said transoms are formed of a material selected from the group consisting of elastomers, rubbers, and ultrahigh molecular weight polyethylene.

4. In a sectional boat having first and second buoyant hulls, each said hull having a bow section and a stern section including a transom, said first and second hulls having joinable first and second transoms, the improvement comprising said first and second transoms having a corrugated outer surface comprised of ridges and furrows, the ridges and furrows of said first transom adapted to interlock with the ridges and furrows of said second transom, each of said first and second buoyant hulls have having wheel assemblies extending upwardly from their stern section.

5. The sectional boat of claim 4 wherein each of said first and second buoyant hulls have at least one handle extending from the bow section.

6. In a sectional boat having first and second buoyant hulls, each said hull having a bow section and a stern section including a transom, said first and second hulls having joinable first and second transoms, the improvement comprising first and second transom plates attached respectively to each of said first and second transoms, each of said first and second transom plates having a corrugated outer surface comprised of ridges and furrows, the ridges and furrows of said first transom plate adapted to interlock with the ridges and furrows of said second transom plate.

7. The sectional boat of claim 6 wherein said transom plates are formed of an abrasion and rust resistant material.

8. The sectional boat of claim 7 wherein said transom plates are formed of a material selected from the group consisting of elastomers, rubbers, and ultrahigh molecular weight polyethylene.

9. The sectional boat of claim 6 wherein each of said first and second buoyant hulls have wheel assemblies extending upwardly from their stern section.

10. The sectional boat of claim 9 wherein each of said first and second buoyant hulls have at least one handle extending from the bow section.

11. The sectional boat of claim 6 wherein said transom plate of said first buoyant hull has a plurality of locking projections extending therefrom and said transom plate of said second buoyant hull has a plurality of locking openings located therein and adapted to snugly receive said locking projections.

* * * * *